United States Patent [19]

Ericsson

[11] Patent Number: 4,628,647

[45] Date of Patent: Dec. 16, 1986

[54] METHOD FOR MOUNTING A ROOF, FLOOR OR SIMILAR STRUCTURE AND A STRUCTURE ADAPTED TO BE MOUNTED ACCORDING TO THE METHOD

[75] Inventor: Axel B. R. Ericsson, Holmsund, Sweden

[73] Assignee: Profoment Utvecklings AB, Sweden

[21] Appl. No.: 448,991

[22] PCT Filed: Mar. 15, 1982

[86] PCT No.: PCT/SE82/00067

§ 371 Date: Nov. 16, 1982

§ 102(e) Date: Nov. 16, 1982

[87] PCT Pub. No.: WO82/03237

PCT Pub. Date: Sep. 30, 1982

[30] Foreign Application Priority Data

Mar. 16, 1981 [SE] Sweden ..... 8101651

[51] Int. Cl.[4] ..... E04B 1/74; E04B 7/00

[52] U.S. Cl. ..... 52/173 R; 52/63; 52/64; 52/145; 52/407; 52/643; 52/645

[58] Field of Search ..... 52/66, 643, 63, 64, 52/173 R, 407, 645, 145

[56] References Cited

U.S. PATENT DOCUMENTS

| | | | |
|---|---|---|---|
| 2,603,171 | 7/1952 | Smith | 52/643 |
| 2,733,482 | 2/1956 | Doman et al. | 52/173 X |
| 2,780,090 | 2/1957 | Rasmussen | 52/407 X |
| 2,957,483 | 10/1960 | Dunn | 52/63 |
| 3,566,562 | 3/1971 | White | 52/173 X |
| 3,894,370 | 7/1975 | Parazader | 52/173 |
| 4,038,788 | 8/1977 | Claessons | 52/15 |

FOREIGN PATENT DOCUMENTS

| | | | |
|---|---|---|---|
| 1193658 | 5/1965 | Fed. Rep. of Germany | 52/173 |
| 1242346 | 6/1967 | Fed. Rep. of Germany . | |
| 2438376 | 2/1976 | Fed. Rep. of Germany . | |
| 2282027 | 3/1976 | France | 52/66 |
| 2341715 | 9/1977 | France | 52/645 |
| 158625 | 4/1957 | Sweden . | |
| 3380343 | 9/1964 | Switzerland . | |
| 487212 | 12/1975 | U.S.S.R. | 52/645 |

*Primary Examiner*—Alfred C. Perham

*Attorney, Agent, or Firm*—Burns, Doane, Swecker & Mathis

[57] ABSTRACT

Method for mounting a structure comprising a number of girders or similar as a roof, floor or similar. The girders are interconnected at their lower side by a flexible sheet or similar and the unit thus assembled is pushed together by moving the girders close together and folding the flexible sheet. The unit is transported from the manufacturing place to the building site, where the unit is placed in its final place and the girders are moved apart to their final position. A structure is adapted to be mounted according to the method having girders interconnected by a flexible member at their lower ends.

11 Claims, 8 Drawing Figures

METHOD FOR MOUNTING A ROOF, FLOOR OR SIMILAR STRUCTURE AND A STRUCTURE ADAPTED TO BE MOUNTED ACCORDING TO THE METHOD

In the building branch there is a continuous balancing between how great part of the work shall be performed on the spot (in situ) and how great part shall be pre-fabrication. Often prefabrication of floors, walls and roofs leads to various types of blocks which are joined together at the building site. This results in gain of working time and a reliable level of qualilty. The drawbacks are problems with tightness, joints, transports, handling and adaptability.

The present invention solves this problem by a limited pre-fabrication in the form of a semi-manufactured product, which leaves certain operations to be performed at the building site. The invention provides several advantages with respect to the building procedure. The assembly is quick and gives reliable dimensions and tolerances. There are no problems with joints as between pre-fabricated blocks. The semi-fabricate is easy to handle and cheap to transport and store.

Closer details of the invention appear from the following specification with the following drawings.

Figure 1:
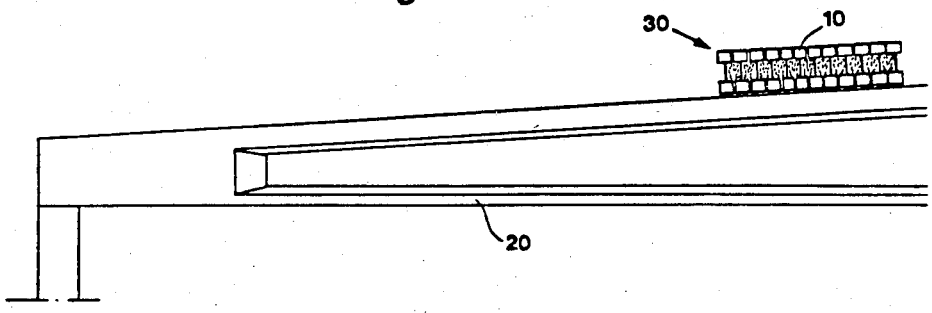
Figure 2:
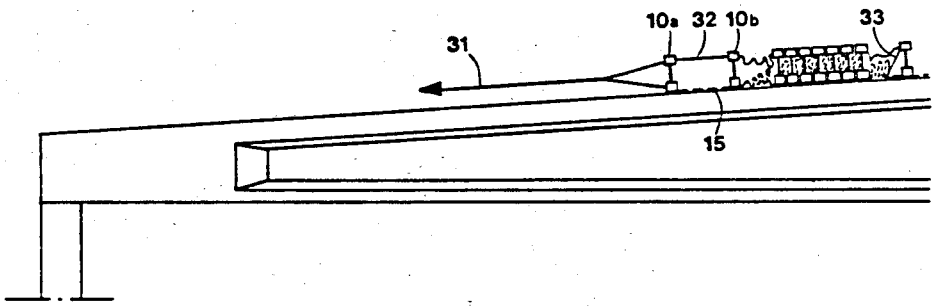
Figure 3:
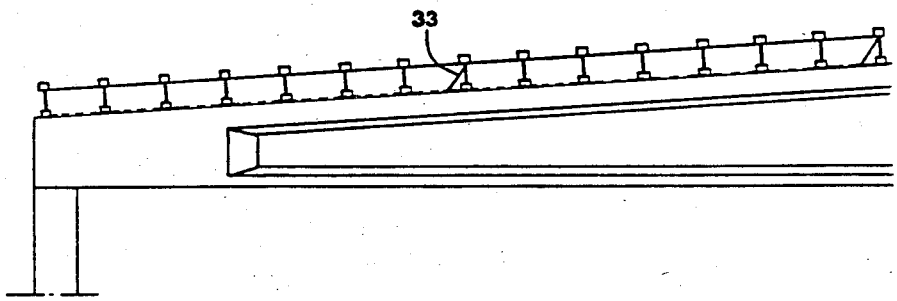

FIGS. 1–3, different stages of the mounting of a roof according to the invention.

Figure 4:
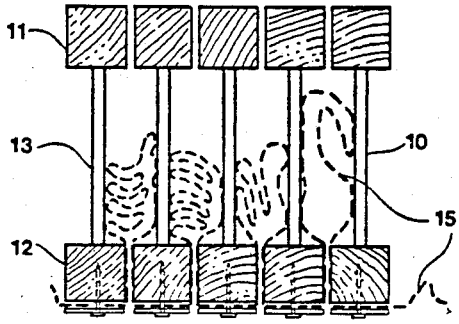

FIG. 4, a package of girders on a larger scale with an interconnecting flexible layer in contracted state for transport and handling.

Figure 5:
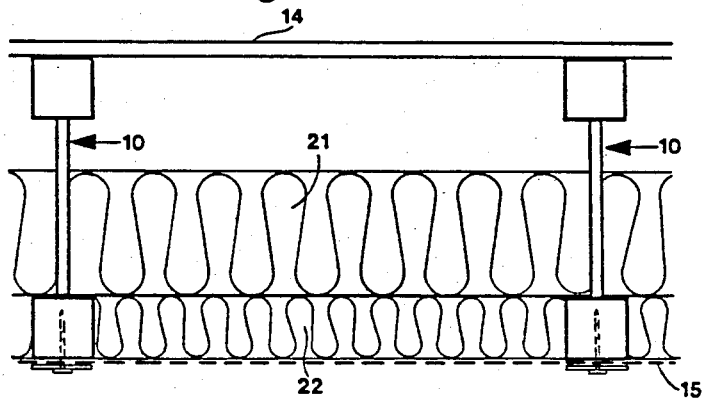

FIG. 5, end view of two girders of the package in FIG. 4 after drawing out the package to final position in a roof floor or the like.

Figure 6:
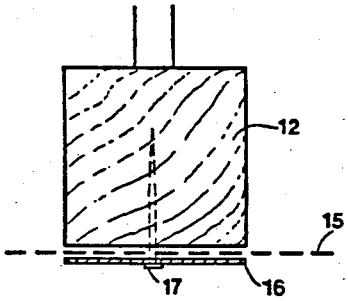

FIG. 6, a detail on a still larger scale showing the lower portion of a girder in FIG. 5.

Figure 7:
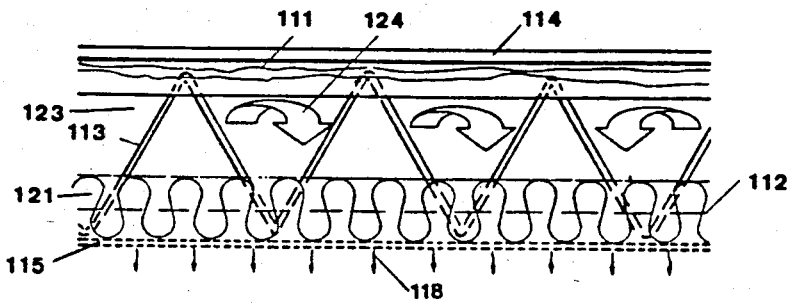

FIG. 7, an elevational view parallel to the longitudinal direction of an embodiment of the girders in FIG. 5.

Figure 8:
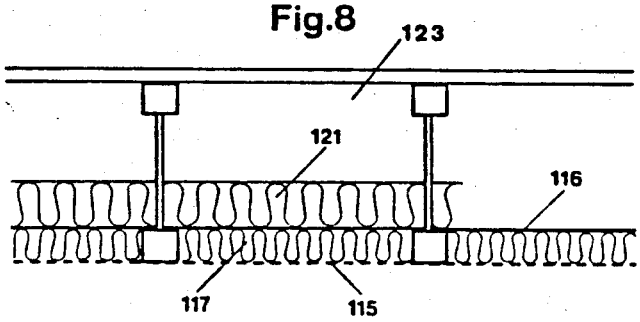

FIG. 8, an alternative embodiment of the section shown in FIG. 5.

FIG. 1 shows a roof construction comprising main girders 20, one of which is shown in side or elevation view, and secondary girders 10 shown in end view. FIG. 1 illustrates a stage in the mounting of the roof with a package 30 of secondary girders 10 which are moved close together. This package forms a transport unit which facilitates transport, storing and other handling of the girders in connection with their transfer from the place where they are manufactures to the place where they are finally mounted.

In the stage illustrated in FIG. 1 the girder package 30 has been lifted up and placed on the main girders 20, resting on at least two adjacent main girders 20. FIG. 2 shows a further stage where a traction force 31 has been applied to the girder 10*a* furthest to the left and has pulled this and the subsequent girder 10*b* from the rest of the package 30. The girders are interconnected by a flexible sheet material or similar 15 at their lower side and a similar layer or one or more flexible strips 32 at their upper side. The opposite end of the package has been pulled out in the opposite direction and is supported by an inclined strut 33. FIG. 3 shows the final mounting stage, the girder package 30 being fully pulled out. The girders are now evenly distributed along the main girders 20, the spacing between them being determined by the flexible ties 15 and 32. An extra strut 33 has been added at the middle of the extended package.

FIGS. 4–6 show on a larger scale a girder system corresponding to the one shown in FIGS. 1–3. In this case the package of girders has been shown as resting on a horizontal support instead of the slightly inclined main girders as in FIGS. 1–3. FIG. 4 shows the girders 10 in contracted state as in FIG. 1, and FIG. 5 shows two girders in drawn apart state corresponding to FIG. 3. FIG. 6 shows on a still larger scale the lower flange 12 with adjoining elemants. The girders consist of an upper and lower flange 11 and 12 respectively and a web 13. In the illustrated case the flanges are supposed to be made of wood and the web of metal as shown in FIG. 7, but this is no necessary requisite in the general adaption of the invention. Between the girders a flexible layer 15 is attached, which can consist of various suitable materials and have various suitable structures as later described. The layer or sheet 15 is attached to the bottom side of the lower flange 12 by means of an underlying plate 16 and fastening means 17 as screws, nails or similar.

The primary function of the flexible sheet or layer 15 is to hold the system of girders 10 together and define the positions of the girders when the package 30 is mounted. In this function the sheet 15 may be made of various flexible materials, e.g. textile, plastic and similar, and it may be shaped in different ways, e.g. a water- and air-tight uniform sheet, a perforated sheet, a net or a system of parallel and/or crossing strips or threads. The choice between these different alternatives depends on the requisites which are put on the structure.

In its simplext form the invention consists of the girder system containing the girders 10 and the connecting flexible sheet 15 at the bottom end of the girders. The girders are for usual prposes equal and parallel to each other with equal spacing. It is convenient to have a flexible member as a sheet, strips or similar 32 also at the top of the girders in order to keep the girders upright during the mounting. In this form the structure can be used for example in a roof or a floor in an unheated building as a store.

Often there are further requisites on the structure as for example that the roof, floor or similar shall be insulating. In that case the flexible layer at the bottom of the girders should be strong enough to carry a heat insulating layer between the girders and moreover preferably strong enough to carry the workers who build the structure and put the heat insulating layer in its place. In such case the requisite may be that there should be no risk that the workers tread through the layer.

FIG. 5 shows an arrangement of a heat insulating layer. Between the girders 10 there are two layers 21 and 22 of heat insulating material, which may be the same in both layers, the bottom layer being slightly narrower to match the narrower space between the flanges. In this case, when an additional layer is inserted from above, the upper flexible members 32 suitably have the form of strips or similar in order to let through the heat insulating layer when it is mounted. On top of the structure there is a panel 14 for further support of additional components, the type of which depends on the type of structure, roof, floor etc.

The girders 10 can in the general embodiment have different shapes. A suitable type for many purposes is the lattice type girder shown in elevational view in FIG. 7 because of its light weight and great stiffness. It consists of upper and lower flanges 111 and 112 respectively which are made of wood and a web 113 in the form of a rod of metal, suitably steel, bent to zigzag shape, the bent portions of the rod being countersunk into recesses in the flanges and fastened with glue or similar as shown in for instance PCT-application PCT/SE79/00253. The insulating layer 121 has its top surface below the upper flange 111, so that a space 123 is formed between the top panel 114 and the insulatinglayer 121, which space can be used for circulation of air either for ventilation or heating and for mounting of wires and tubes in the transverse direction of the girders through the openings in the lattice structure.

FIG. 7 illustrates a specific advantage of the present invention used in a roof structure. The insulating layer 121 can be made air penetrable so that fresh air can be taken from inside and conducted along the space 123 and led through the insulating layer 121 as indicated by the arrows 124 and then through the sheet or layer 115 and into the underlying room as shown by the arrows 118. This requires necessarily that the layer 115 is air penetrable. The air thus flowing through the structure forms a counter-current to the heat flow through the heat insulating material 112, thus forming a heat exchange between the outlet and the inlet air. This has been described in Swedish patent No. 300 297.

A variation on this theme can be used in a floor on top of a cellar or similar space. Hor air from the house can be pumped through the insulating layer down into the cellar thus heating the cellar with the heat in the outlet air. This has been described in Swedish patent No. 7511197-1.

A further embodiment is shown in FIG. 8 where the present method and structure are used for simplifying the mounting of a sound reducing layer on the underside of a floor structure. The demand for a good sound reducing ability of a ceiling is nowadays increasing. It is usually expensive to install ceilings which meet this demand, because sound absorbing slabs are usually mounted from below. This problem can be solved by means of the present invention, as shown in FIG. 8.

In the structure shown in FIG. 8 the flexible layer 115 consists of a net, a system of strips or the like having so large through openings that the slab 117 lying on top of the layer 115 to a substantial extent is exposed downwards. The slab 117 is sound reducing and this effect is preserved, because a sound coming from below passes through the openings in the flexible layer and into the sound absorbing slab, where it is eliminated or at least reduced. In this way a sound absorbing layer can be mounted from above instead of from below, which is much more convenient. On top of the sound reducing layer 117 a foil 116 and a heat insulating layer 121 can be placed which both, as well as the sound reducing layer 117, can be air penetrable or not depending on whether the structure is to be used for air circulation as above described.

The method and the structure can of course be used in all types of roofs, floors and similar having a girder system adaptable in accordance with the invention.

I claim:

1. A pre-fabricated component structure for a permanent structure comprising a plurality of girders for a roof, floor or similar, the girders being interconnected at their lower edges by flexible sheet means, said flexible sheet means defining a predetermined spacing between the girders, each girder comprising an upper elongated member, a lower elongated member and spacer means interposed between said upper and lower members for spacing said upper and lower members from and generally parallel to each other, adjacent pairs of spaced girders and said flexible sheet means bounding an area for receiving heat insulating material, said flexible sheet means permitting the girders of said component structure to be pushed close together to form a compact unit by folding the flexible sheet means, whereby the component structure may be transported from the manufacturing place to a building site where the component structure is placed in its final position and the girders may be moved apart to their final position with the predetermined spacing between the girders.

2. The structure as defined in claim 1 wherein said spacer means of the girders each include a lattice structure and a space is provided between a heat insulating layer and an upper part of the component structure.

3. The structure as defined in claim 1, further comprising fasteners for attaching the flexible sheet means to the girders, the flexible sheet means including the fasteners being adapted to carry workers on the structure.

4. The structure as defined in claim 1, wherein a heat insulating layer is arranged on the flexible sheet means.

5. The structure as defined in claim 4, wherein the heat insulating layer and the flexible sheet means are air penetrable and are adapted to form part of an air circulation system.

6. The structure as defined in claim 5 wherein a space is provided between the heat insulating layer and an upper part of the structure.

7. The structure as defined in claim 1, wherein said spacer means of the girders each include a lattice structure, said upper and lower members of adjacent pairs of girders of said compact unit abutting each other, respectively, with said lattice structures of adjacent pairs of girders spaced apart from each other so as to define stowage areas between said adjacent pairs of girders, each stowage area adapted to confine a portion of said flexible sheet means extending between the respective pair of adjacent girders, whereby said flexible sheet means is substantially enclosed within said compact unit.

8. The structure as defined in claim 1, further comprising a sound reducing layer situated on top of the flexible sheet means, the flexible sheet means having openings exposing the sound reducing layer downwards.

9. The structure as defined in claim 8, wherein the structure contains both a sound reducing layer and a heat insulating layer.

10. The structure as defined in claim 8 or 9, wherein the sound reducing layer is air penetrable.

11. The structure as defined in claim 1, wherein the girders are interconnected at their upper edges by second flexible sheet means.

* * * * *